US010381155B2

(12) United States Patent
De León et al.

(10) Patent No.: US 10,381,155 B2
(45) Date of Patent: Aug. 13, 2019

(54) WINDING FOR LOW-VOLTAGE COILS OF DISTRIBUTION-CLASS TOROIDAL TRANSFORMERS

(71) Applicant: New York University, New York, NY (US)

(72) Inventors: Francisco De León, Bogota, NJ (US); Saeed Jazebi, New York, NY (US)

(73) Assignee: NEW YORK UNIVERSITY, New York, NY (US)

( * ) Notice: Subject to any disclaimer, the term of this patent is extended or adjusted under 35 U.S.C. 154(b) by 131 days.

(21) Appl. No.: 15/240,669

(22) Filed: Aug. 18, 2016

(65) Prior Publication Data

US 2017/0053740 A1 Feb. 23, 2017

Related U.S. Application Data

(60) Provisional application No. 62/206,785, filed on Aug. 18, 2015.

(51) Int. Cl.

*H01F 7/06* (2006.01)
*H01F 41/076* (2016.01)
*H01F 41/08* (2006.01)

(52) U.S. Cl.

CPC ..... *H01F 41/076* (2016.01); *H01F 41/08* (2013.01); *Y10T 29/4902* (2015.01); *Y10T 29/49071* (2015.01)

(58) Field of Classification Search

CPC .... H01F 27/306; H01F 30/16; H01F 27/2895; H01F 17/062; H01F 41/08; H01F 27/2804; H01F 41/041; H01F 1/14766; H01F 27/06; H01F 41/02; H01F 41/076; Y10T 29/49073; Y10T 29/4902; Y10T 29/49071; H02M 7/066

USPC ..... 336/229, 170, 180, 186, 205, 206, 150, 336/183, 192, 226, 84 C; 323/344, 301; 29/605, 602.1, 606, 608, 609

See application file for complete search history.

(56) References Cited

U.S. PATENT DOCUMENTS 3,168,715 A * 2/1965 Woodworth ..... H01F 17/062 333/119
3,996,543 A * 12/1976 Conner ..... H01F 27/06 336/58
RE33,345 E * 9/1990 Sylvester, Jr. ..... H01F 30/16 336/180
7,071,678 B2 * 7/2006 Karlsson ..... G01R 15/185 324/117 R

OTHER PUBLICATIONS

NPL_Hyper-Physics_Webpage_BasicRotationalQuantities_http://hyperphysics.phy-astr.gsu.edu/hbase/rotq.html.*

* cited by examiner

*Primary Examiner* — Thiem D Phan
(74) *Attorney, Agent, or Firm* — Foley & Lardner LLP

(57) ABSTRACT

A novel winding method is described herein which eliminates the circulating currents for wound transformers. A first layer of a wire is wound about the core at a first set of angles. Next, a loop is pulled to form slack in the wire and the wire is continued to be wound at a second set of angles. The loop provides sufficient slack for the cutting and connecting described further below. The winding and loop pulling continues for s sequences to achieve the desired winding. The wire is then cut at each loop.

6 Claims, 4 Drawing Sheets

(a)

(b)

WINDING FOR LOW-VOLTAGE COILS OF DISTRIBUTION-CLASS TOROIDAL TRANSFORMERS

CROSS-REFERENCE TO RELATED PATENT APPLICATION

This application claims the benefit of U.S. Provisional Application No. 62/206,785, filed on Aug. 18, 2015, which is hereby incorporated by reference in its entirety.

TECHNICAL FIELD

The present disclosure relates generally to methods for transformers, more specifically to winding strategy for low-voltage coils of toroidal transformers.

BACKGROUND

There are several issues in the construction process of the low-voltage windings of toroidal distribution-grade transformers that need to be resolved before mass production can be embarked. A major problem still unresolved is the lack of technology to wind thick wires. For example, the winding machines available are only capable of winding magnet wires with gauge of up to #6 AWG. The other issue is that thicker wires lose flexibility as their thickness increases making it impossible to properly bend the wires at the edges of the core. This yields to undesired inhomogeneous spaces between core and windings and also different winding layers. Therefore, more insulation is needed between the windings, the final size of the transformer increases, and the thermal performance is negatively affected.

An alternative, is to use thick stranded welding cables. These cables are flexible enough for this purpose. There are three known major problems with this winding strategy:

- Currently, there is not winding machine that can handle the entire wire of the low voltage winding. This is so because, first, the cable should be completely loaded on the magazine (cable cannot be cut into pieces). The weight and the length of cable for a distribution class transformer are outside the limit of existing winding machines.
- According to the above mentioned issues, the winding process is not automated. Therefore, this method it is very time consuming, labor intensive, and expensive.
- Transformers designed for lower temperatures are bulky and therefore, more expensive. According to IEEE/ANSI standards dry-type transformers can be designed for 150° C. (hot spot temperature). Welding cables offer a temperature rating of up to 105° C. Operating temperatures higher than 105° C. are possible in dry-type transformers (up to 220° C.), but the insulation (jacket) of the cables is not adequate for this. Therefore, transformers need to be designed for lower temperature bringing the price up.

The best approach is to use several thin conductors in parallel for a winding that carries large current (e.g. low voltage windings). The conventional continuous winding strategy (layer by layer), results in circulating currents which increase the winding losses tremendously. This is so because parallel windings would have different lengths, and consequently different impedances. The parallel connection of wires with different resistances yields non-uniform distribution of current between them. In this condition, the wire with lower resistance carries more current than the other conductors. This unbalanced condition produces higher losses as shown with a simple example consisting of three parallel conductors (see FIG. 1). In this figure two cases are compared: three conductors with the same length (same resistance) and three conductors with different lengths (different resistance).

The resistance of a conductor with cross section area A, length l, and electrical conductivity ρ can be computed by:

$$R = \rho \frac{l}{A}$$

Note that A and ρ are equal for all conductors. On the left hand case of FIG. 1, three conductors have the same length. Therefore, resistances of the three conductors are equal to R. On the right hand case of FIG. 1, the second and the third conductors are assumed to be 25% and 33.3% longer than the first conductor, respectively. The equivalent circuits of these two cases are shown in FIG. 1.

The equivalent resistance seen from the terminals of the circuit shown in FIGS. 1(*a*) and (*b*) are R/3, and 20R/51, respectively. Assuming a constant current load, the real power loss of the circuit shown in FIG. 1(*b*) is 17.65% higher than the real power loss of the circuit of FIG. 1(*a*).

SUMMARY

Embodiments described herein relate generally to a method for winding a layer of a transformer comprising: determining a number ($N_p$) of parallel conductors for the layer; determining a number ($N_{t,i}$) of turns per layer for each parallel conductor; beginning at a first terminal and leaving a first terminal end, winding a wire, and a first prime terminal end, about a transformer core at a first sequence of angles; forming a first loop of wire; winding the wire about the transformer core at a second sequence of angles; forming a second loop of wire; winding the wire about the transformer core at a third sequence of angles; cutting the first loop of wire to form a second terminal end and second prime terminal end; cutting the second loop of wire to form a third terminal end and third prime terminal end; connecting the first terminal end; the second terminal end and third terminal end; connecting the first prime terminal end, and the second prime terminal end, and the third prime terminal end; and wherein a first parallel conductor is defined by the first end and second prime end, a second parallel conductor is defined by the second end and the third prime end, and a third parallel conductor is defined by the third end and the first prime end.

In some embodiments, a method is described for winding a transformer comprising: selecting a number of turns n for a winding in a transformer; determining a number of parallel conductors $N_p$ to substitute for the winding; and determining a number of layers m for the transformer. For each layer m, defining a number of turns per layer $N_{t,i}$, and winding $N_p$ sequences, wherein each sequence s of the $N_p$ sequences has $N_{t,i}$, turns each at an angle $\theta_{p,s}$ defined by $$\theta_{p,s} = \frac{360° \times p}{N_{t,i}} + \frac{s \times 360°}{N_{t,i} \times N_p}$$

$$p = 0, 1, \ldots, (N_{t,i} - 1)$$

$$s = 0, 1, \ldots, (N_p - 1)$$

where, $\theta_{p,s}$ is the angle correspond to the $p^{th}$ turn of the $N_{t,i}$, total number of turns and the $s^{th}$ sequence of the $N_p$ total number of sequences; where $s=N_p$ for the last turn.

Between each of the $N_p$ sequences, pulling a loop, then cutting each loop to form $N_p$ parallel conductors each having two terminal ends, and connecting each parallel conductor of a layer in parallel. Finally, connecting respective terminal ends of each layer in series.

It should be appreciated that all combinations of the foregoing concepts and additional concepts discussed in greater detail below (provided such concepts are not mutually inconsistent) are contemplated as being part of the subject matter disclosed herein. In particular, all combinations of claimed subject matter appearing at the end of this disclosure are contemplated as being part of the subject matter disclosed herein.

BRIEF DESCRIPTION OF DRAWINGS

The foregoing and other features of the present disclosure will become more fully apparent from the following description and appended claims, taken in conjunction with the accompanying drawings. Understanding that these drawings depict only several implementations in accordance with the disclosure and are therefore, not to be considered limiting of its scope, the disclosure will be described with additional specificity and detail through use of the accompanying drawings.

Figure 1A:
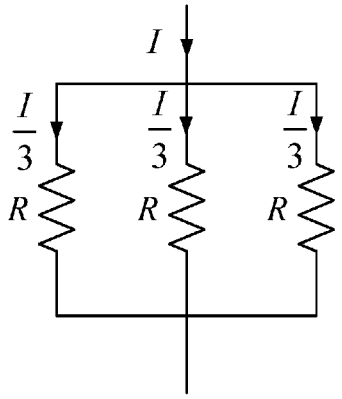
FIG. 1A is a demonstration of current distribution in parallel conductors with a balanced distribution.

Reference is made to the accompanying drawings throughout the following detailed description. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

DETAILED DESCRIPTION OF VARIOUS EMBODIMENTS

Embodiments described herein relate generally to a winding method for transformers. Specifically, some embodiments are directed to a winding method for low-voltage coils of toroidal transformers, including those sufficient to serve as distribution-class transformers.

To overcome the drawbacks a novel winding strategy is proposed here which eliminates the circulating currents. This method always yields to the optimum (balanced) case shown in FIG. 1(*a*).

Some embodiments relate to a method that facilitates replacement of the cables with magnet wires coated by varnish. Magnet wires are available for higher temperature classes that are ideal to use for dry-type transformers. Since the method is applied for low-voltage windings, the thin varnish cover suffices to insulate neighboring turns. Hence, cables with thick insulations are avoided and the size of the final toroid is reduced substantially. Also, the thermal performance of the transformer is improved, because less insulation is being used. Further, the winding process can be completely automated. Therefore, the manpower and lead time for the LV windings reduce considerably. All the aforementioned advantages reduce the manufacturing cost of toroidal transformers.

Winding Method

In one embodiment, a winding method is provided. The method will be described for illustrative purposes with regard to a low-voltage (LV) winding with n turns that need to be wound in m layers. In a toroidal design, the number of turns per layer is different. The number of turns (n) is defined by Faraday's law of induction. This is so because, after winding the inner layers, the inner diameter of the toroid decreases. Thus, less wire fits in the inner circumference. The number of turns per layer is based upon the geometry of the toroid and the wire, for example the outer diameter, inner diameter, and height of the core, wherein the outer diameter and inner diameter decrease with subsequent layers while the height increases. The wire gauge, and insulation thickness as well as the desired fill factor can be used to determine the number of turns per layer $N_{t,i}$. The number of layers (m) is based on the calculated number of turns for the desired transformer based on Faraday's law of induction and the number of turns per layer achievable for the intended transformer core and selected wire.

Assume that the number of turns in the different layers are: $N_{t,i}$, where i=1, 2, 3, . . . m (thus $N_{t,m}$). Also, suppose that the objective is to substitute the conventional thick wire with $N_p$ parallel conductors. Hence, $N_{t,i}\times N_p$ turns of thin wires shall fit in a layer. Each layer shall be wound in $N_p$ steps (sequence). Here a sequence is defined as a complete sweep of a winding machine along the circumference of the toroid (360°). Each layer is wound in a series of sequences providing parallel conductors, but it should be appreciated that all of the parallel conductors in a layer effectively function as a single thicker wire would have when connected in parallel.

Figure 1B:
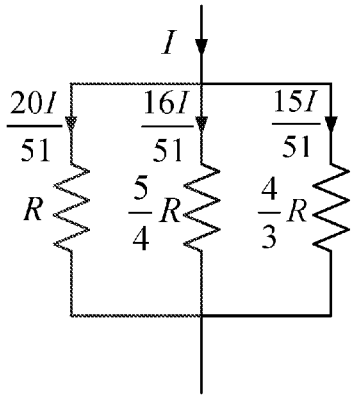
FIG. 1B is a demonstration of current distribution in parallel conductors with an unbalanced distribution caused by circulating currents.
Figure 2:
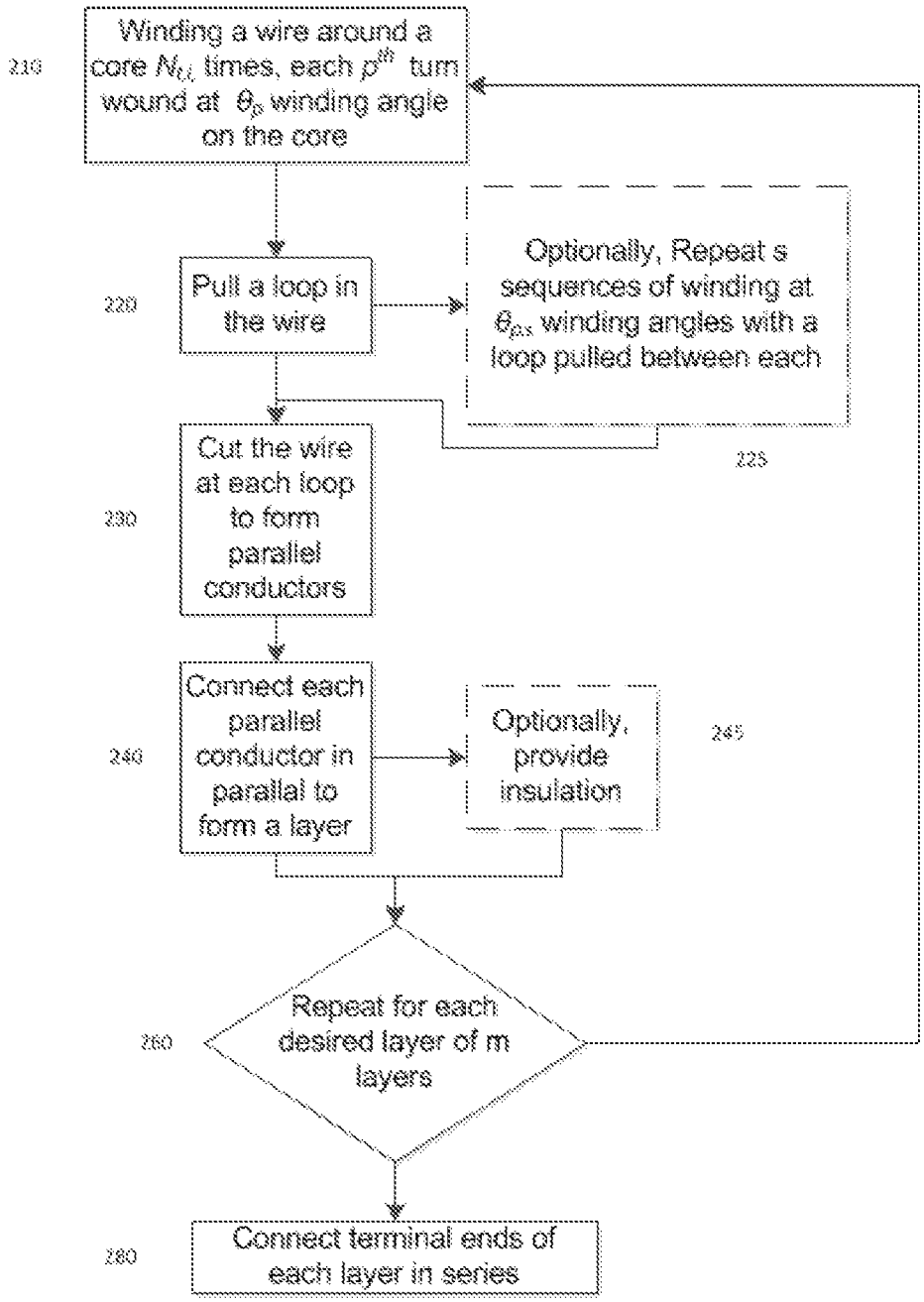
FIG. 2 is a flow chart illustrating one embodiment of a winding method.

FIG. 1 illustrates one embodiment of a winding method. Angles are with respect to the toroidal core and the start point indicated as terminal 1 (the zero angle). At a first step 210, the first layer is wound $N_{t,i}$, total number of times (turns) about the core at a first set of angles $\theta_p$ corresponding to each of the $N_{t,i}$, windings. The first set of angles winds around the entire circumference of the core. Next at 220, a loop is pulled to form slack in the wire. Optionally at step 225, additional windings can be made by the wire for s sequences, winding each at $\theta_{p,s}$ winding angle and pulling a loop in between each sequence, with each sequence circumnavigating the entire core. The loop provides sufficient slack for the cutting and connecting described further below. At step 230, the wire is then cut at each loop. At step 240, parallel connections are made between the windings. Optionally, insulation may be provided at step 245, such as to provide insulation between layers. A layer is thus formed comprising individual parallel conductors connected in parallel and each parallel conductor having two terminal ends.

The process of in steps 210-245 can be repeated at step 260 for a desired number of times to form m layers. Each successive layer may have a its own number of turns per layer based on the wire size and total layer thickness already wound. The terminals of the different layers are then connected in series.

More specifically, in one embodiment of a winding method can be summarized as follows:

1: In the first sequence, the first layer is wound on the following angles on the circumference of the core: 0, 360°/$N_{t,i}$, 2×360°/$N_{t,i}$, 3×360°/$N_{t,i}$, . . . , that means:

$$\theta_{p,1} = \frac{360° \times p}{N_{t,i}}$$

$$p = 0, 1, \ldots, (N_{t,i} - 1)$$

where, $\theta_{p,1}$ is the angle corresponding to the $p^{th}$ turn in the $1^{th}$ sequence.

2: The next step is to pull a loop and continue winding on the following angles:

$$\theta_{p,2} = \frac{360° \times p}{N_{t,i}} + \frac{1 \times 360°}{N_{t,i} \times N_p}$$

$$p = 0, 1, \ldots, (N_{t,i} - 1)$$

where, $\theta_{p,2}$ is the angle corresponding to the $p^{th}$ turn in the $2^{th}$ sequence.

3: The next step is to pull a loop and continue winding on the following angles:

$$\theta_{p,3} = \frac{360° \times p}{N_{t,i}} + \frac{2 \times 360°}{N_{t,i} \times N_p}$$

$$p = 0, 1, \ldots, (N_{t,i} - 1)$$

4: The above procedure will continue for $N_p$ times (sequences). The following equation is the general formula to compute the corresponding angle to the position of each turn for the $s^{th}$ sequence (s=$N_p$ for the last turn):

$$\theta_{p,s} = \frac{360° \times p}{N_{t,i}} + \frac{s \times 360°}{N_{t,i} \times N_p}$$

$$p = 0, 1, \ldots, (N_{t,i} - 1)$$

$$s = 0, 1, \ldots, (N_p - 1)$$

Where:

$\theta_{p,s}$=the angle for the $p^{th}$ turn of $s^{th}$ sequence $N_{t,i}$=total number of turns in a layer $N_p$=total number of parallel conductors (i.e. substituted for a thick wire)

5: The wires are cut at the loops. Subsequently, the parallel connections are made and insulation (if needed) is provided. The $2^{nd}$, $3^{rd}$, . . . $n^{th}$ layers shall be wound in the same manner.

The process is repeated for m number of layers to achieve the desired number of turns in the transformer.

The last step is to connect the terminal of different layers in series.

EXAMPLE

Figure 3:
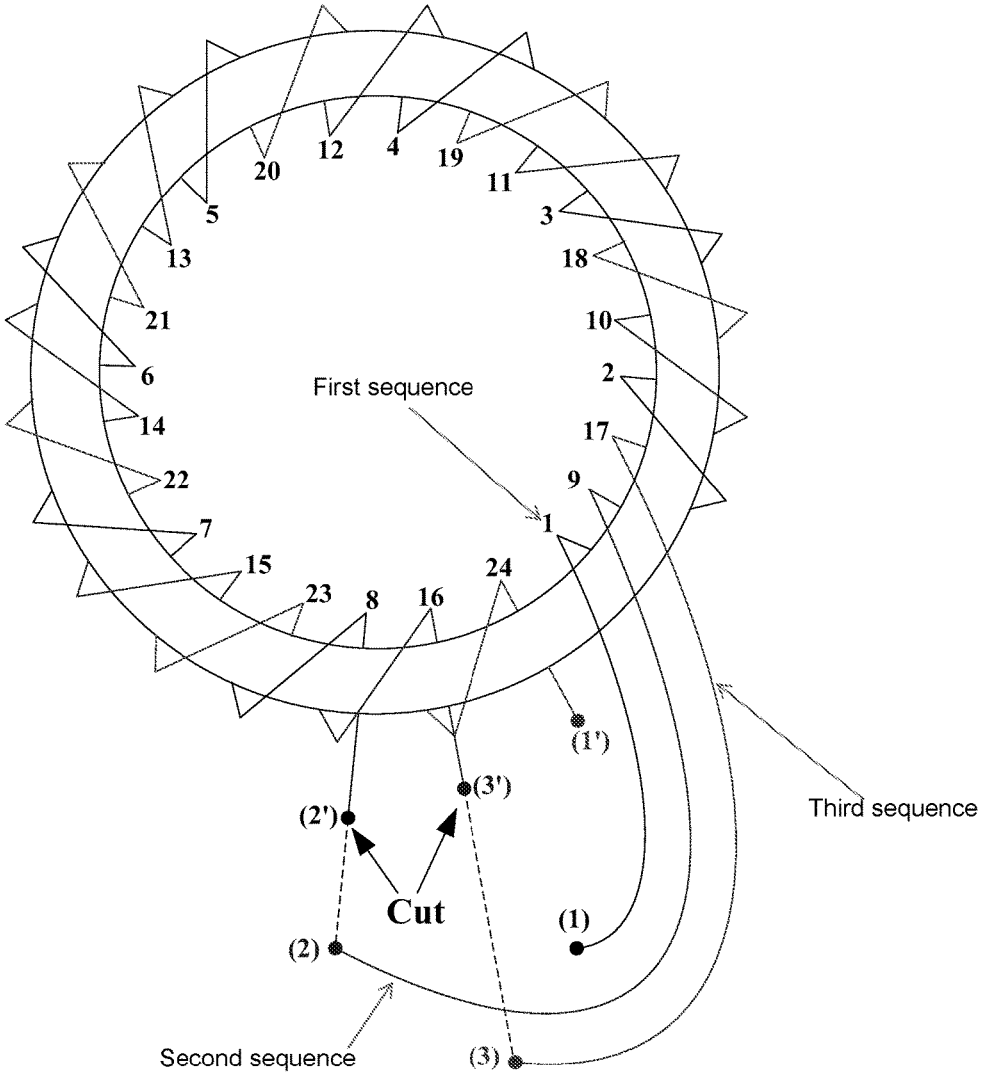
FIG. 3 illustrates one proposed winding strategy for a coil with $N_{t,1}=8$ turn per layer that consists of $N_p=3$ parallel conductors.

The new winding strategy is applied for a coil with n=26. The winding has m=4 layers ($N_{t,1}$=8, $N_{t,2}$=7, $N_{t,3}$=6, $N_{t,4}$=5). The thick winding is replaced with three thin conductors ($N_p$=3). A complete first layer of this winding is shown in FIG. 3. The winding process starts from terminal (1).

The first sequence is shown with the wire that is wound on the circumference of the toroid on the following angles: 0°, 45°, 90°, . . . , 270°, 315°.

Next, a loop is pulled, and the winding process continues for the second sequence. The wire is wound on the following angles: 15°, 60°, 105°, . . . , 285°, 330°. Next, a loop is pulled and the third (last) sequence is started. The wire is wound on the following angles: 30°, 75°, 120°, . . . , 300°, 345°.

The winding process and cutting results in terminal ends. As best seen in FIG. 3 the initial starting end of the wire is the first terminal end (1), the first loop of wire is cut to form a second terminal end (2) and a second prime terminal end (2'), a second loop of wire is cut to form a third terminal end (3) and a third prime terminal end (3'). Thus, the wire is cut at points (2), (2') and (3), (3'). Thus, each sequence is three separate wires despite being wound as a continuous wire.

Next, terminals (1), (2), (3) and (1'), (2'), (3') are connected together, respectively. This forms the first layer.

The second layer has 7 turns. Thus, the first term $$\frac{360° \times p}{N_{t,i}},$$

will have as its demoninator 7. The second term, $$\frac{s \times 360^T}{N_{t,i} \times N_p},$$

will have as its demoninator 21 (7×3) instead of 24 (8×3) in the first layer. The first sequence of the second layer is wound on the circumference of the toroid on the following angles: 0°, 51.43°, 102.86°, . . . , 257.14°, 308.57°. Next, a loop is pulled, and the winding process continues for the second sequence. The wire is wound on the following angles: 17.14°, 71.27°, 120°, . . . , 274.28°, 325.71°. Next, a loop is pulled and the third (last) sequence is started. The wire is wound on the following angles: 34.29°, 85.72°, 137.15°, . . . , 291.43°, 342.86°.

Computer Implementations

Figure 4:
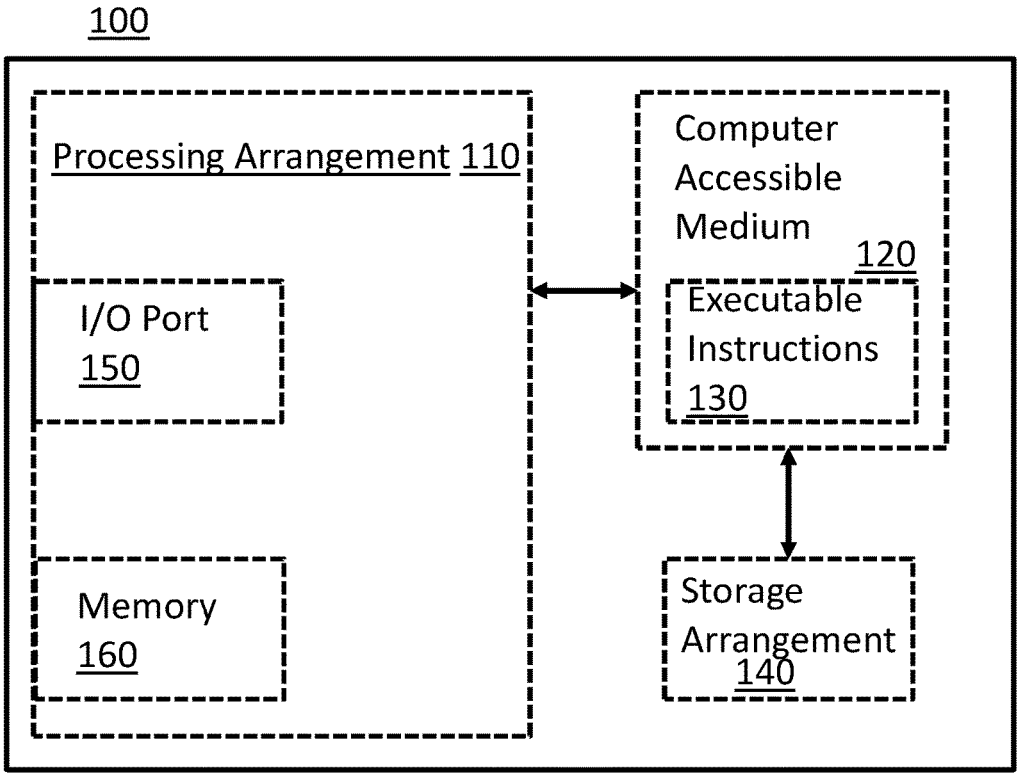
FIG. 4 illustrates a computer system for use with certain implementations.

Certain aspects of the winding may be controlled by a computer implemented device. For example, an automated winding apparatus may perform the method as described above. A user may input the desired winding parameters. As shown in FIG. 4, e.g., a computer-accessible medium 120 (e.g., as described herein, a storage device such as a hard disk, floppy disk, memory stick, CD-ROM, RAM, ROM, etc., or a collection thereof) can be provided (e.g., in communication with the processing arrangement 110). The computer-accessible medium 120 may be a non-transitory computer-accessible medium. The computer-accessible medium 120 can contain executable instructions 130 thereon. In addition or alternatively, a storage arrangement 140 can be provided separately from the computer-accessible medium 120, which can provide the instructions to the processing arrangement 110 so as to configure the processing arrangement to execute certain exemplary procedures, processes and methods, as described herein, for example. The instructions may include a plurality of sets of instructions.

System 100 may also include a display or output device, an input device such as a key-board, mouse, touch screen or other input device, and may be connected to additional systems via a logical network. Many of the embodiments described herein may be practiced in a networked environment using logical connections to one or more remote computers having processors. Logical connections may include a local area network (LAN) and a wide area network (WAN) that are presented here by way of example and not limitation. Such networking environments are commonplace in office-wide or enterprise-wide computer networks, intranets and the Internet and may use a wide variety of different communication protocols. Those skilled in the art can appreciate that such network computing environments can typically encompass many types of computer system configurations, including personal computers, hand-held devices, multi-processor systems, microprocessor-based or programmable consumer electronics, network PCs, minicomputers, mainframe computers, and the like. Embodiments of the invention may also be practiced in distributed computing environments where tasks are performed by local and remote processing devices that are linked (either by hardwired links, wireless links, or by a combination of hardwired or wireless links) through a communications network. In a distributed computing environment, program modules may be located in both local and remote memory storage devices.

Various embodiments are described in the general context of method steps, which may be implemented in one embodiment by a program product including computer-executable instructions, such as program code, executed by computers in networked environments. Generally, program modules include routines, programs, objects, components, data structures, etc. that perform particular tasks or implement particular abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps.

Software and web implementations of the present invention could be accomplished with standard programming techniques with rule based logic and other logic to accomplish the various database searching steps, correlation steps, comparison steps and decision steps. It should also be noted that the words "component" and "module," as used herein and in the claims, are intended to encompass implementations using one or more lines of software code, and/or hardware implementations, and/or equipment for receiving manual inputs.

Definitions

As used herein, the singular forms "a", "an" and "the" include plural referents unless the context clearly dictates otherwise. Thus, for example, the term "a member" is intended to mean a single member or a combination of members, "a material" is intended to mean one or more materials, or a combination thereof.

As used herein, the terms "about" and "approximately" generally mean plus or minus 10% of the stated value. For example, about 0.5 would include 0.45 and 0.55, about 10 would include 9 to 11, about 1000 would include 900 to 1100.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Other substitutions, modifications, changes and omissions may also be made in the design, operating conditions and arrangement of the various exemplary embodiments without departing from the scope of the present invention.

While this specification contains many specific implementation details, these should not be construed as limitations on the scope of any inventions or of what may be claimed, but rather as descriptions of features specific to particular implementations of particular inventions. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A method for winding a layer of a transformer comprising:

determining a number ($N_p$) of parallel conductors for the layer;

determining a number ($N_{t,i}$) of turns per layer for each parallel conductor;

beginning at a first terminal and leaving a first terminal end, winding a wire, and a first prime terminal end, about a transformer core at a first sequence of angles;

forming a first loop of wire;

winding the wire about the transformer core at a second sequence of angles;

forming a second loop of wire;

winding the wire about the transformer core at a third sequence of angles;

cutting the first loop of wire to form a second terminal end and a second prime terminal end;

cutting the second loop of wire to form a third terminal end and a third prime terminal end;

connecting the first terminal end; the second terminal end and third terminal end;

connecting the first prime terminal end, and the second prime terminal end, and the third prime terminal end; and wherein a first parallel conductor is defined by the first terminal end and second prime terminal end, a second parallel conductor is defined by the second terminal end and the third prime terminal end, and a third parallel conductor is defined by the third terminal end and the first prime terminal end.

2. The method of claim 1, wherein the first sequence of angles is determined by:

$$\theta_{p,1} = \frac{360° \times p}{N_{t,i}}$$

$$p = 0, 1, \ldots, (N_{t,i} - 1).$$

3. The method of claim 2, wherein the second sequence of angles is determined by:

$$\theta_{p,2} = \frac{360° \times p}{N_{t,i}} + \frac{1 \times 360°}{N_{t,i} \times N_p}$$

$$p = 0, 1, \ldots, (N_{t,i} - 1).$$

4. The method of claim 3, wherein the third sequence of angles is determined by:

$$\theta_{p,3} = \frac{360° \times p}{N_{t,i}} + \frac{2 \times 360°}{N_{t,i} \times N_p}$$

$$p = 0, 1, \ldots, (N_{t,i} - 1).$$

5. The method of claim 4, further comprising connecting in parallel the first parallel conductor, the second parallel conductor, and the third parallel conductor.

6. A method for winding a transformer comprising:

selecting a number of turns n for a winding in the transformer;

determining a number of parallel conductors $N_p$ to substitute for the winding;

determining a number of layers m for the transformer;

for each layer m, defining a number of turns per layer $N_{t,i}$, and winding sequences s, wherein each sequence s of the parallel conductors $N_p$ has $N_{t,i}$, turns each at an angle $\theta_{p,s}$ defined by $$\theta_{p,s} = \frac{360° \times p}{N_{t,i}} + \frac{s \times 360°}{N_{t,i} \times N_p}$$

$$p = 0, 1, \ldots, (N_{t,i} - 1)$$

$$s = 0, 1, \ldots, (N_p - 1)$$

where, $\theta_{p,s}$ is the angle corresponding to the $p^{th}$ turn of the $N_{t,i}$, total number of turns and the $s^{th}$ sequence of the $N_p$ total number of sequences;

where $s=N_p$ for the last turn;

between each of the $N_p$ sequences, pulling a loop;

cutting each loop to form $N_p$ parallel conductors each having two terminal ends;

connecting each parallel conductor of a layer in parallel; and connecting respective terminal ends of each layer in series.

* * * * *